United States Patent [19]

Cushman

[11] 4,429,753

[45] Feb. 7, 1984

[54] ROTARY PULL DOWN PULL UP DRIVE FOR DRILL PIPES

[75] Inventor: Richard Cushman, Westland, Mich.

[73] Assignee: Noster Industries, Inc., Garden City, Mich.

[21] Appl. No.: 390,272

[22] Filed: Jun. 21, 1982

[51] Int. Cl.[3] ..... E21C 1/10

[52] U.S. Cl. ..... 173/149; 173/165; 414/431; 414/745; 74/840

[58] Field of Search ..... 173/145, 148, 149, 150, 173/152, 163, 165; 74/665 A, 840; 198/624; 414/431, 432, 745, 757; 464/139, 141

[56] References Cited

U.S. PATENT DOCUMENTS

| | | | |
|---|---|---|---|
| 403,086 | 5/1889 | Blessley | 464/139 X |
| 2,316,117 | 4/1943 | Tilley | 414/431 |
| 3,307,725 | 3/1967 | Fecto | 414/431 |
| 4,128,133 | 12/1978 | Hug | 173/149 |
| 4,262,756 | 4/1981 | Blanz . | |

FOREIGN PATENT DOCUMENTS

| | | | |
|---|---|---|---|
| 1228909 | 4/1902 | France | 414/431 |

*Primary Examiner*—Frederick R. Schmidt
*Assistant Examiner*—Robert P. Olszewski
*Attorney, Agent, or Firm*—Cullen, Sloman, Cantor, Grauer, Scott & Rutherford

[57] ABSTRACT

A gear drive used in water well drilling or blast hole drilling to remove overburden in open pit coal mining, not only rotates the drill pipe but also pulls down or pulls out the drill pipe as it rotates. A hydraulic motor within a housing operates a first gear train to rotate an output shaft at varying speeds. A drill pipe is projected through the output shaft. A plurality of feed rollers are mounted on spherical bearings, the outside diameter of the rollers having a concave recess for operative registry with the drill pipe. When the output shaft is rotated, each roller cocks and digs into the feed pipe causing it to rotate with the output shaft. The pull down and pull up section is driven by a hydraulic motor within the housing through a second gear train. The second gear train drives a plurality of third gear trains for individually driving the respective feed rollers.

1 Claim, 2 Drawing Figures

2
2
111
D
58
57
57
151
125
123
103
129
118
113
101
104
117
115
105
107
109
99
97
95
69
71
91
89
87
85
83
81
79
75
77
73
67
93
121
119
55
53
51
49
47
45
43
41
39
37
35
33
31
29
27
25
23
21
19
17
15
13
24
61
63
65

ROTARY PULL DOWN PULL UP DRIVE FOR DRILL PIPES

BACKGROUND OF THE INVENTION

The present rotary pull down drive is used in connection with water well drilling or blast hole drilling to remove overburden in open pit coal mining and related drilling areas. In such drilling the tubular drill pipe mounting drill bits of the desired construction is projected through an upright tubular output shaft which is supported and journaled for rotation upon a vertical axis upon a suitable platform. Various mechanisms have been employed for establishing a driving relationship between the output shaft and the drill pipe. Various mechanisms have heretofore been employed for causing the drill pipe to advance into the ground or to be withdrawn therefrom.

There has long existed the need for an improved rotary pull down pull up drive for such drill pipe which in a simplified manner will effect rotation of the drill pipe and at the same time is adapted to feed the drill pipe downwardly and alternately upwardly in simultaneous actions.

SUMMARY OF THE INVENTION

It is an important feature of the present invention to provide an improved rotary pull down pull up drive for a drill pipe which mounts upon a centrally apertured housing upon a platform, an upright tubular output shaft which projects through and is journaled upon an upright axis and is adapted to receive the drill pipe projected therethrough. A plurality of feed rollers are mounted upon a superstructure housing with the outside diameter of rollers having a concave recess for operative registry with the drill pipe. A plurality of gear trains are employed for rotatively driving the output shaft and for rotatively driving in one direction or the other a plurality of angularly related feed rollers mounted upon the superstructure housing with the rollers in such operative engagement with the feed pipe that on rotation of the rollers in a horizontal plane, the feed pipe is rotated about its axis and upon rotative drive applied to the rollers the same rollers are adapted to operatively feed the drill pipe longitudinally downwardly or upwardly during continuous rotation of the drill pipe.

An important object of the present invention is to provide an improved rotary pull down pull up drive for a drill pipe utilizing a housing mountable upon a platform wherein the output shaft is supported and journaled upon a vertical axis within the housing and is adapted to receive a drill pipe which projects therethrough and wherein a first hydraulic motor operates through a gear train to rotate the output shaft upon a vertical axis wherein a second hydraulic motor operating through a second gear train and through a plurality of individual third gear trains is adapted to drive a plurality of angularly related rollers which rotate on horizontal axes. The feed rollers which are in operative engagement with the drill pipe so that rotation and translation of the feed rollers in a horizontal plane due to the gripping action with the drill pipe causes a corresponding rotation of the drill pipe about its vertical axis and at the same time power rotation of the respective feed rollers simultaneously advances the drill pipe downwardly and upon rotation in the opposite direction of the feed rollers will pull the drill pipe upwardly on its vertical axis while rotating.

An important feature of the present invention is to provide in conjunction with a hydraulic motor and gear train for effecting a rotation of the tubular output shaft upon a vertical axis and with a series of additional gear trains connected to a second hydraulic motor adapted to effect a rotative drive of a plurality of angularly related feed rollers in operative frictional engagement with the drill pipe such that during continuous rotation of the drill pipe under the control of the feed rollers, the power rotation of the feed rollers is adapted to simultaneously advance the drill pipe longitudinally of the feed pipe in one direction and upon power rotation of the feed rollers in the opposite direction to move the feed pipe in the opposite direction.

An important feature of the present invention is the construction of the housing structure for mounting the hydraulic motors and for supporting and journaling the respective gear trains and the intermeshing gears thereof in such fashion as to rotatively support and journal the upright feed pipe which receives the drill pipe and at the same time through a series of second and third gear trains connected with a second hydraulic motor adapted to operatively drive a plurality of angularly related feed rollers supported and journaled upon a superstructure housing overlying the housing and secured to the output shaft for simultaneous rotation therewith.

A further important feature resides in the construction of the multiple sets of third gear trains by which rotary power transmitted from a spindle journaled upon the output shaft is transmitted to the individual third gear trains for transmitting a rotative drive to a plurality of independent horizontal feed shafts which support the feed rollers driving the feed rollers for rotation upon horizontal axes and with the feed rollers in operative driving engagement with the drill pipe for rotating the drill pipe and for advancing and/or retracting the drill pipe.

An important feature resides in the construction of the mounting, support and drive for the individual feed rollers upon the superstructure housing wherein the respective third gear trains rotate in a horizontal plane along with the rotation of the superstructure housing upon which they are mounted, journaled and supported wherein the feed rollers while rotating in horizontal planes dig into the surface of the drill pipe so as to rotate the drill pipe upon its vertical axis within the feed pipe and simultaneously to frictionally engage the drill pipe to advance the drill pipe longitudinally downwardly or upwardly depending upon the direction of rotation.

These and other objects and features will be seen from the following specification and claims in conjunction with the appended drawings.

THE DRAWING

Figure 1:
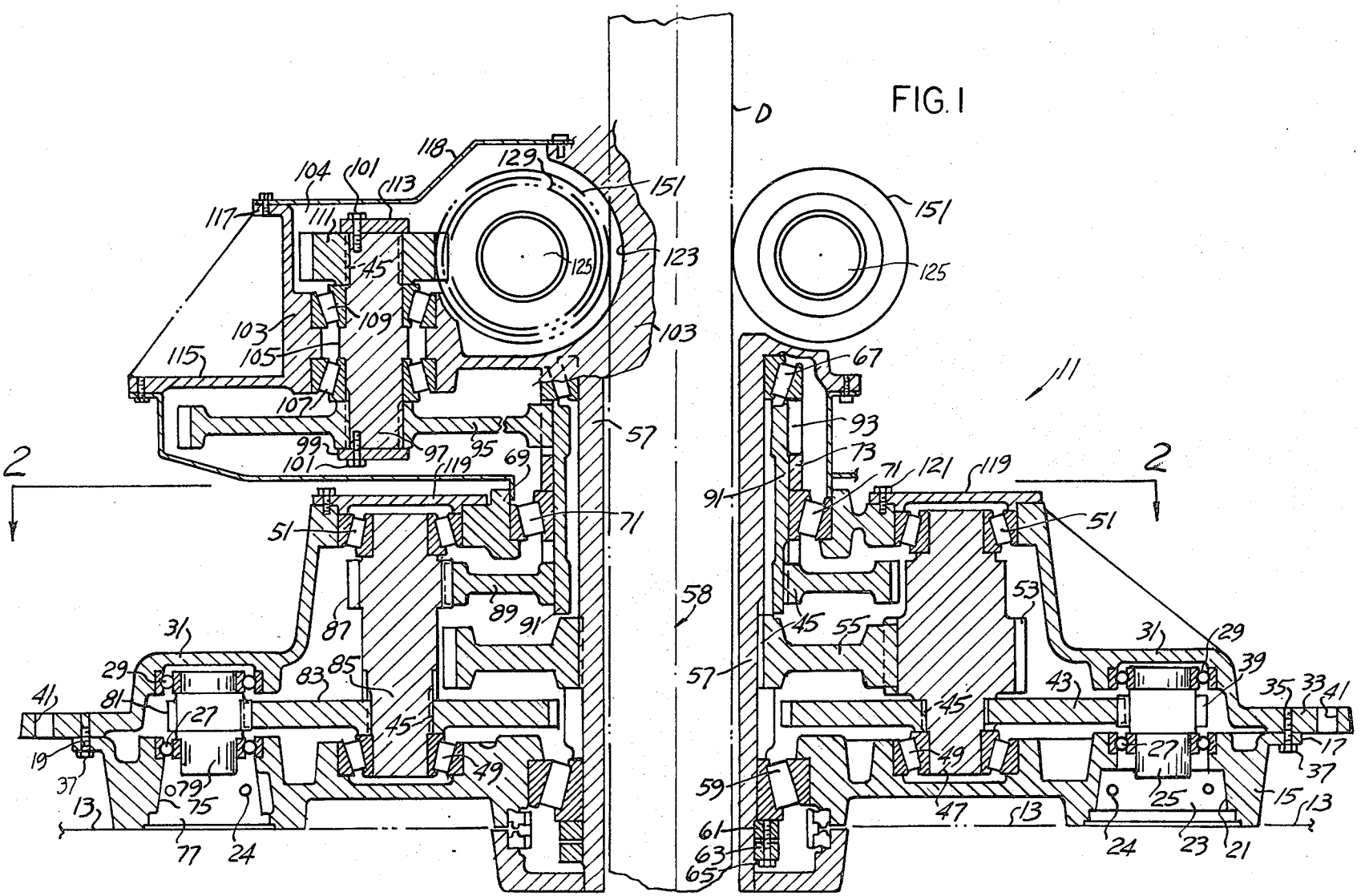
FIG. 1 is a fragmentary side elevational view of the present rotary pull down pull up drive for a drill pipe.

It will be understood that the above drawings illustrate merely a preferred embodiment of the invention and that other embodiments are contemplated within the scope of the claims hereafter set forth.

DETAILED DESCRIPTION OF AN EMBODIMENT OF THE INVENTION

Referring to the drawings, the present rotary pull down pull up drive for drill pipes is designated at 11. Mounted upon a suitable bed or platform 13, fragmentarily shown, is a cast housing 15 suitably secured thereto and having a peripheral flange 17 apertures at 19.

Within recess 21 in said housing, there is mounted and secured a reversible first hydraulic motor 23 having a pair of fluid pressure ports 24. Upright drive shaft 25 extends through bearings 27 mounted upon said housing and at its other end is journaled and supported within additional bearings 29 supported and retained within the cast cover 31 which overlies the housing 15 and has a registering peripheral flange 33 with threaded apertures 35. A plurality of fasteners 37 extend through housing flange 17 and into cover flange 33 securing the cover to said housing. Additional apertures 41 are formed within cover flange 33 to provide a means of anchoring the cover to platform 13 as desired.

First motor drive shaft 25 intermediate its ends has thereon a pinion 39. Pinion 39 is in mesh with gear 43 keyed at 45 upon the upright first stud shaft 47 which at one end is supported and journaled within bearings 49 within said housing. The opposite end of stud shaft 47 extends into and is supported and journaled within corresponding bearings 51 mounted and supported within cover 31.

Concentric with gear 43 and mounted on or otherwise joined to first stud shaft 47 is the pinion 53 which is in mesh with gear 55 keyed as at 45 upon the upright rotatable output shaft 57 of tubular construction. Said output shaft is journaled and supported upon bearings 59 adjacent one end within the housing 15. Ring 61 keyed upon output shaft 57 supportably engages bearings 59. Support ring 63 is keyed upon upright output shaft 57 underlies the ring 61 and is adjustably secured thereto as by the fasteners 65, FIG. 1.

Top bearing 67 is mounted upon the cover 31 and is adapted to supportably mount and journal an upper end portion of the upright output shaft 57 whose vertical axis is designated at 58, FIG. 1. Drill pipe D, which in the illustrative embodiment is 5 inches in diameter, being a conventional dimension, but not limited thereto loosely projects down through the upright output shaft 57 along the axis 58, through the housing 15 and platform 13 down into the ground surface and is adapted to mount upon its end a conventional form of drill bit or other drilling assembly.

Upper end portions of the drill pipe D project through the upright output shaft 57 and upwardly through the superstructure housing 103 hereafter described. Annular bearing support 69 mounts the bearing 71, FIG. 1, and is secured to or forms a part of the cover 31. Bearing 71 supports the spacer sleeve 73 which engages the pinion 93 which is suitably keyed to or forms an integral part of spindle 91.

Within a corresponding recess 75 within the housing 15, there is positioned and secured a second hydraulic motor 77 having corresponding fluid pressure ports 24 and an upright drive shaft 79, sometimes referred to as the second upright drive shaft, mounting pinion 81. Drive shaft 79 is journaled within bearings 27 within housing 15 at one end, and at its upper end within corresponding bearings 29 mounted within cover 31.

Pinion 81 is in mesh with gear 83 which is suitably keyed as at 45 upon the second upright stud shaft 85. Said shaft at its lower end is supported and journaled within bearings 49 within said housing and at its upper end within corresponding bearings 51 within cover 31.

Concentric with gear 83 and mounted upon or a part of the second upright stud shaft 85 is a pinion 87 which is in mesh with gear 89, keyed as at 45 upon the lower end of the upright spindle 91. Said spindle surrounds the upright output shaft 57 upon axis 58 and is supportably mounted and journaled upon the bearing 71 mounted upon bearing support 69 forming a part of or connected to cover 31.

Pinion 93 at the upper end of the spindle 91 overlies the spacer ring 73 which is supportably mounted upon the bearing assembly 71 for mounting the spindle against endwise movement with respect to the upright output shaft 57.

The first gear train which establishes a drive between the first hydraulic motor 23 and upright output shaft 57 includes pinion 39 on the first motor drive shaft 25, gear 43, concentric pinion 53 in mesh with gear 55 keyed to the upright output shaft 57.

The second gear train is connected to the second hydraulic motor 77 spaced from the axis 58. Its upright second drive shaft 79 mounts pinion 81 in mesh with gear 83 on second upright stud shaft 85 which mounts pinion 87 in mesh with gear 89 keyed at 45 to the upright spindle 91.

Figure 2:
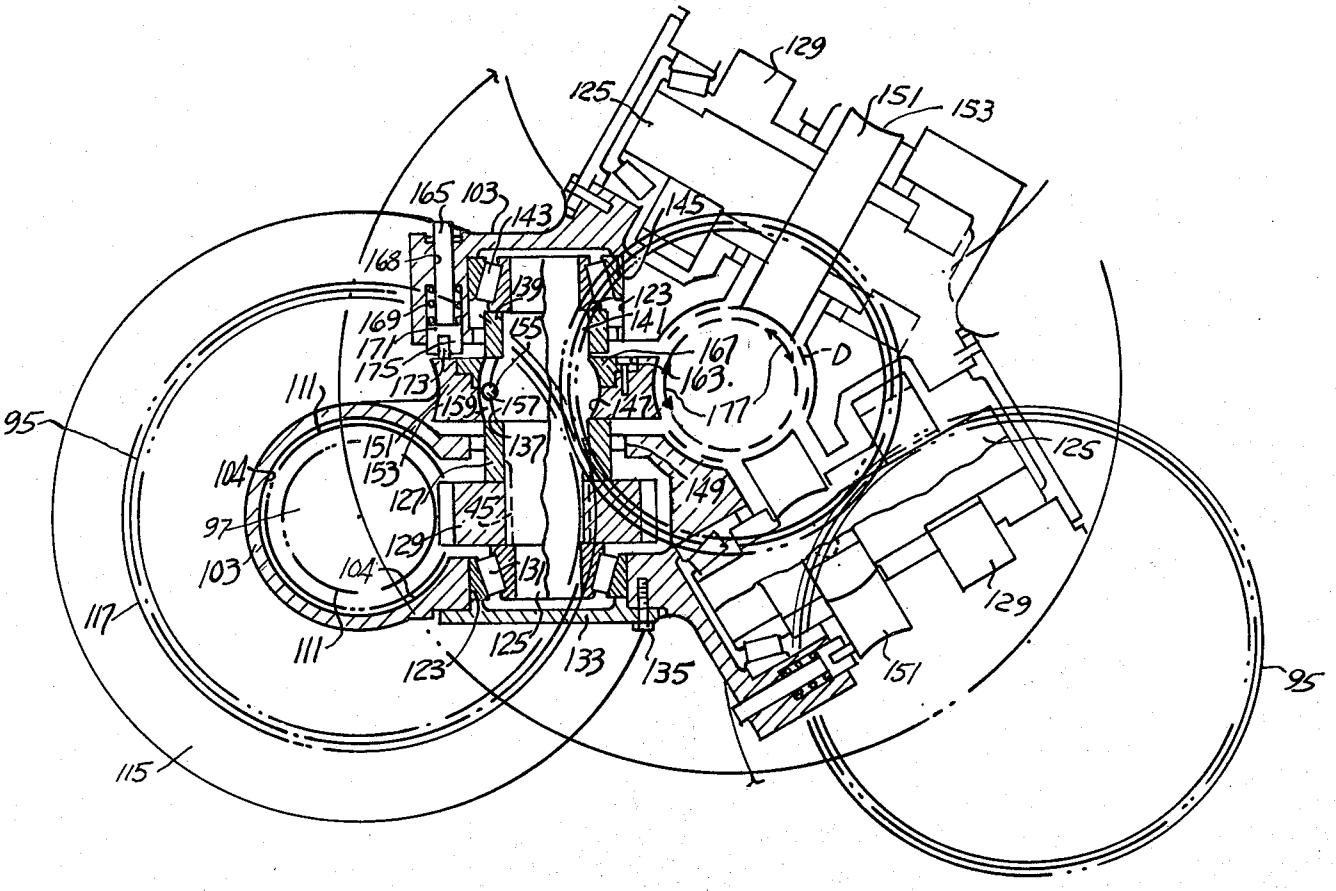
FIG. 2 is a fragmentary section taken in the direction of arrows 2—2 of FIG. 1.

Pinion 93 upon the spindle 91 is adapted for driving a plurality of third gear trains, one, of which is shown in detail in FIGS. 1 and 2. Each of the respective third gear trains is adapted for connection with spindle pinion 93 for driving one of the angular related feed rollers 151 shown in FIG. 2. Said feed rollers are adapted for operative frictional engagement with the drill pipe D which projects up through the superstructure housing 103 which mounts the respective third gear trains, of which there are three in this embodiment.

One of the third gear trains is illustrated in FIGS. 1 and 2 and includes gear 95 in mesh with spindle pinion 93 and which is secured at one end of the upright stud shaft 97 by anchor plate 99 and fasteners 101. Upright stud shaft 97 is mounted and journaled upon superstructure housing 103 within a bore 104 therein wherein is positioned a pair of longitudinally spaced bearings 107 and 109 arranged upon opposite sides of and in supporting engagement with annular shoulder 105 upon stud shaft 97.

Concentric with gear 95 keyed as at 45 to the upper end of stud shaft 97 is the pinion or worm gear 111 retained thereon by the anchor plate 113 with corresponding fasteners 101. Superstructure housing 103 includes lower peripheral flange 115 which overlies the housing 15 and its cover 31 and is spaced therefrom for rotation relative to said housing and cover. The superstructure housing also includes an upper peripheral flange 117 which is suitably apertured to receive a plurality of fasteners for connecting a cover plate 118.

The top plates 119, FIG. 1 overlie the corresponding upright stud shafts 47 and 85 within the housing 15 and cover 31 and are secured thereto by fasteners 121, which extend into the bearing support 69 forming a part of cover 31. The top plates 119 serve as an anchor for the upper stud shaft support bearings 51.

Formed within the superstructure housing 103 are a plurality of horizontal bores 123, FIGS. 1 and 2, adapted to receive the corresponding top horizontal shaft 125 upon which the corresponding feed roller 151 is mounted in FIG. 2. In the illustrative embodiment, there are a plurality of angularly related feed rollers 151 shown in FIG. 2, each spaced apart 120°, mounted upon horizontal support shafts 125. Each shaft includes an annular shoulder 127 intermediate its ends and adjacent said shoulder a spiral gear or worm wheel 129 keyed at 45 to top shaft 125.

End thrust bearing 131 retained within bore 123 of the superstructure housing 103 supportably engages and journals the horizontal shaft 125 at one end thereof. Bearing retainer 133 supportably engages the bearings 131 and is suitably secured to the superstructure housing as by fasteners 135. Formed upon horizontal shaft 125 intermediate its ends is a spherically shaped bearing 137. Circular spacer 139 is mounted upon shaft 125 adjacent the spherical bearing 137 and keyed thereto as at 141. The outer end of shaft 125 is supportably journaled and mounted within end thrust bearing 143 which bears against the shoulder 145, FIG. 2, within a portion of the superstructure housing 103.

The worm wheel or spiral gear 129 is keyed upon horizontal shaft 125 and is in mesh with the corresponding worm gear 111 shown in detail in FIG. 1 upon the upright stud shaft 97. Adjacent the bearings 143 for shaft 125 is a suitable wiper seal 149 nested within bore 123 of the superstructure housing 103 and in wiping engagement with the spacer ring 139, FIG. 2. An additional wiper seal 149 surrounds the shaft 125 and is in sealing engagement with its shoulder 127.

The feed roller 151, which rotates upon a horizontal axis defined by the horizontal shaft 125, has a annular concave recess 153 in its outer surface adapted for cooperative registry with the corresponding convex surface of the drill pipe D which is arranged centrally of the corresponding feed rollers 151, FIG. 2. The transverse radius of the recess 153 corresponds substantially to the radius of the drill pipe D, adapted for cooperative engaging registry therewith.

The feed roller 151 has an internal spherical recess 147 which receives spherical bearing 137. A ball slot drive means is interposed between bearing 137 and feed roller 151. Ball 157 is nested within spherical socket 155 within bearing 137 with a portion of the ball projecting into longitudinally extending arcuate slot 159 formed upon the interior of the roller 151 inwardly of its spherical recess 147, FIG. 2. Ball retainer 167 fits within a corresponding annular recess within the feed roller 151 retainingly engaging ball 157 and is secured to the feed roller by fasteners 163.

The mounting of the feed roller 151 with respect to the spherical bearing 137 upon shaft 125 is such that feed roller 151 is adapted to cock or rotate in a vertical plane a limited amount as shown by the arrows at 177 so that portions of the feed roller 151 dig into the sides of the feed pipe D for operative frictional engagement therewith.

Within a transverse bore 168 formed within the superstructure houing 103, FIG. 2, there is provided a side thrust pin 165 which is biased by the spring 169 mounted within the superstructure housing and bears against shoulder 171. Side thrust roller 173 is journaled as at 175 upon the inner end of the pin 165 and is in yieldable operative retaining engagement with an outer peripheral side portion of the feed roller 151. Said roller normally returns the feed roller 151 to the position shown in FIG. 2 and yieldably permits some transverse cocking movements of said feed roller in a vertical plane with respect to the spherical bearing 137 on shaft 125.

The foregoing illustrative third gear train of which there are three gear trains, one corresponding to each of the feed rollers 151, includes pinion 93, FIG. 1, upon spindle 91 in mesh with gear 95 on shaft 97 driving worm gear or spiral gear 111 in mesh with the corresponding worm wheel 129 keyed upon horizontal top shaft 125. Thus, the single pinion 73 upon spindle 91 is adapted to drive each of the three third gear trains. Each of the three gear trains has its first gear 95 in mesh with pinion 93. As in FIG. 2, the corresponding first gears 95 of the respective third gear trains are angularly spaced apart at approximately 120° within and upon the superstructure housing 103 to effect individual drive for each of the respective horizontal shafts 125 which mount the corresponding feed rollers 151.

Depending upon the pressure connections to the ports 24 within the first hydraulic motor 23, the first gear train is adapted to rotate the output shaft 57 in one direction or the other. Such rotation rotates the overlying superstructure housing 103 in unison therewith. This in turn effects a corresponding translation or rotation in a horizontal plane of the respective third gear trains which individually drive the corresponding angularly related feed rollers 151, FIG. 2.

The corresponding feed rollers 151 are horizontally translated with respect to the drill pipe D and are in frictional engagement therewith. Such rotation of the superstructure housing will cause the feed rollers 151 to cock or tip angularly in a vertical plane from the position shown in FIG. 2 so that their channel surfaces 153 are adapted to dig into and operatively engage the drill pipe sufficiently to cause a simultaneous rotation of the centrally located drill pipe. The direction of rotation therefore depends upon the direction of rotation of the superstructure housing 103 which overlies the housing 15 and cover 31 at the upper end of output shaft 57.

It is the operation of the second hydraulic motor 77 driving a second gear train to the spindle 91 which effects rotation of the pinion 93 thereon and which effects the rotative drive for the corresponding plurality of third gear trains above described. Each of the third gear trains is connected to the pinion 93 on spindle 91 and in mesh with gear 95 on shaft 97, rotating the worm gear or spiral gear 111 in mesh with the worm wheel or spiral gear 129 upon the horizontal shaft 125 for driving the feed roller 151 in one direction or the other.

With one direction of rotation, the feed rollers in frictional operative engagement with the drill pipe D upon spaced side portions thereof are adapted to advance the drill pipe downwardly into the ground through the support shaft 57 and upon rotation in the opposite direction frictionally engaging the drill pipe so as to raise the drill pipe. This raising and lowering of the drill pipe is simultaneous with the powered rotation thereof upon its vertical axis.

Having described my invention, reference should now be had to the following claims:

I claim:

1. A rotary pull down, pull up drive for a drill pipe comprising a centrally apertured housing mountable upon a platform and having a central vertical axis;

first and second reversible hydraulic motors spaced from said axis secured within said housing;

first and second upright motor drive shafts journaled within said housing;

an upright tubular output shaft projected through said housing and supportably journaled thereon upon said axis, and adapted to axially receive a drill pipe projected therethrough;

a first gear train within said housing interconnecting said first drive shaft and output shaft;

a centrally apertured superstructure housing spaced from and overlying said housing receiving said drill pipe mounted on and secured to said output shaft for rotation therewith;

a plurality of angularly related drill pipe feed rollers rotatably mounted and journaled upon said superstructure housing upon horizontal axes in operative driving engagement with said drill pipe for rotating and longitudinally feeding said drill pipe along said axis;

a spindle mounted around said output shaft rotatively journaled and supported upon said housing;

a second gear train within said housing interconnecting said second drive shaft and said spindle for rotating said spindle upon said axis relative to said output shaft;

and a plurality of third gear trains supported and journaled within and upon said superstructure housing respectively interconnecting said spindle and each of said drill pipe feed rollers;

rotation of said feed rollers upon horizontal axes in one direction feeding said drill pipe downwardly and in the opposite direction feeding said drill pipe upwardly, rotation of said feed rollers in a horizontal plane simultaneously rotating said drill pipe upon said vertical axis;

the mounting of each drill pipe feed roller including a horizontal top shaft mounted and journaled upon said superstructure housing;

a spherical bearing on and intermediate the ends of said top shaft;

said feed roller having a corresponding internal spherical recess receiving said spherical bearing, whereby said feed roller on rotation in a horizontal plane relative to and against said feed pipe is adapted to rotate in a vertical plane relative to its supporting top shaft to frictionally dig into and operatively engage said feed pipe;

a side thrust pin slidably mounted upon said superstructure housing on an axis parallel to said top shaft;

a roller mounted upon said pin in operative engagement with a peripheral side portion of said feed roller;

and a spring means on said superstructure housing yieldably engaging and biasing said pin against said feed roller.

* * * * *